US006146233A

United States Patent [19]

Hedeen, Jr.

[11] Patent Number: 6,146,233

[45] Date of Patent: Nov. 14, 2000

[54] SPINNING TOP

[75] Inventor: Clemens V. Hedeen, Jr., Sturgeon Bay, Wis.

[73] Assignee: Hedeen Toys LLC, Sturgeon Bay, Wis.

[21] Appl. No.: 09/501,117

[22] Filed: Feb. 9, 2000

[51] Int. Cl.[7] ..... A63H 1/08

[52] U.S. Cl. ..... 446/261; 446/247; 446/259

[58] Field of Search ..... 496/236, 247, 496/256, 259, 261, 262, 264

[56] References Cited

U.S. PATENT DOCUMENTS

| | | | |
|---|---|---|---|
| 245,141 | 8/1881 | Dannhorn | 446/259 |
| 521,148 | 6/1894 | Barr, Jr. . | |
| 1,361,637 | 12/1920 | Steen | 446/259 |
| 1,480,858 | 1/1924 | Goetz | 446/264 X |
| 2,610,439 | 9/1952 | Nemeth . | |
| 2,614,364 | 10/1952 | Darden . | |
| 2,616,213 | 11/1952 | Kondrath | 446/261 |
| 3,044,212 | 7/1962 | Lancaster | 446/261 |
| 3,142,933 | 8/1964 | Ruderian . | |
| 3,269,053 | 8/1966 | Dawson, Jr. | 446/261 |
| 3,413,753 | 12/1968 | Colmer, Jr. . | |
| 3,879,887 | 4/1975 | Brookson, Jr. et al. | 446/256 X |
| 5,032,101 | 7/1991 | Hartman | 446/262 |

OTHER PUBLICATIONS 5 pages of excerpts from a web site entitled "Woodturned Spinning Tops", 7/2/399.

*Primary Examiner*—Sam Rimell
*Attorney, Agent, or Firm*—Quarles & Brady LLP

[57] ABSTRACT

Disclosed herein are spinning tops having an improved pull-string attachment system. The pull-string has a toothed catch at one end that engages with a cylindrical hub of the top. The hub is at the center of a deep radial groove transverse to the top's axis of rotation in which the pull-string is wound. When the top is thrown and the pull-string is pulled, the catch smoothly disengages so that the pull-string releases cleanly from the top. Replaceable tips are also provided.

9 Claims, 2 Drawing Sheets

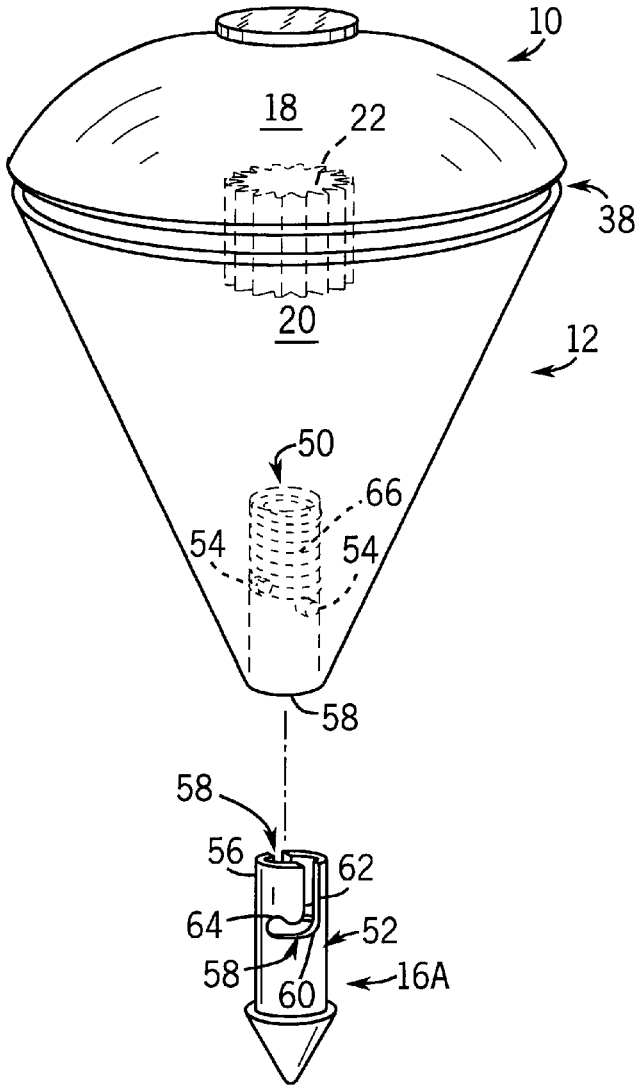
FIG. 6
FIG. 7
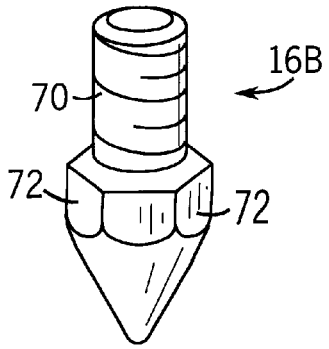

SPINNING TOP

CROSS-REFERENCES TO RELATED APPLICATIONS

Non-applicable.

STATEMENT REGARDING FEDERALLY SPONSORED RESEARCH/DEVELOPMENT

Non-applicable.

BACKGROUND OF THE INVENTION

The spinning top, a classic children's toy, has existed for centuries. Conventional tops typically have a concentrically balanced body usually tapering to a pointed bottom tip, which allows the top to rotate on a flat surface about a spin axis. There have been numerous variations on the basic design, particularly with regard to body configurations optimizing its balance as well as means for initiating the rotation of the top.

A top can be spun by standing it upright on its tip and rotating it by hand (e.g. between a thumb and index finger). Alternatively, a top can be spun with a pull-string wrapped around the outside of the top. With the top standing on its tip, the top may be spun by pulling on a free end of the pull-string to impart a rotation to the top. Alternatively, when wound with such a string the top can be thrown outward to a flat surface while holding onto a free end of the string. This also causes the top to spin separately from the string.

However, such tops are usually intended for very small children who often do not have great manual dexterity or patience. When the top is the type which requires the string to be wrapped in a single layer along a sloped side of the top, young children may be frustrated by the process of winding the string.

Some tops were therefore designed with a deep circumferential groove transverse to the spin axis in which the pull-string was disposed, much like a yo-yo groove. See e.g. U.S. Pat. Nos. 2,610,439; 2,614,364; and 3,413,753. Such grooves permitted the string to be quickly wound around the top even by those having little manual dexterity. However, because the grooves were deep and narrow, there were problems securing the inward end of the pull-string to the top.

For example, the first end could be temporarily held outside of the groove and then overlapped by subsequent windings, as mentioned above. However, the string could jerk backward as the trapped first end was released.

Accordingly, a need exists for an improved spinning top design.

BRIEF SUMMARY OF THE INVENTION

The present invention provides a spinning top with a body having a vertical spin axis, a bottom tip, and a radial groove extending perpendicular to the spin axis and extending into the body to define a cylindrical hub essentially concentric with the spin axis. There is also a recess formed on the hub which is accessible from the radial groove, and a flexible line windable in the groove about the hub, the line having a catch at one end that is matable with the recess.

The line can be used to apply a transverse force to the body so as to rotate the top about the spin axis on its tip, with the catch and recess capable of separating smoothly from each other when the line is completely unwound from the hub.

In preferred forms the recess is a vertical groove and the catch has a tooth and an arc head adjacent the tooth. Also, the body is comprised of an upper part including a transverse lower surface and a lower part including a transverse upper surface, the upper and lower parts being joined together such that the lower and upper surfaces define the groove. The hub may be integrally formed with the upper part, or be separately formed.

In other preferred forms, the lower part has a recess sized to receive a portion of the hub in a press fit, and the tip is removable from the body. To achieve a removable tip, there can be an axial bore in the lower body concentric with the spin axis adjacent its lower end, and the tip can include a longitudinal lug sized to fit within the bore. The connection between the replaceable tip and bore can be a frictional fit, a threaded fit, a bayonet connection or other connection permitting the tip to be replaced when desired.

Thus, the present invention provides a top in which the pull-string can be easily wound by even those having little manual dexterity or patience. Further, the string will release from the top smoothly (e.g. due to the arc shaped configuration and the tooth/groove interaction) so as not to interfere with its rotation. The parts can be formed using mass production molding techniques.

The replaceable tip system allows worn tips to be replaced, thus increasing the useful life of the top. Further, different tips can be used for different types of surfaces (e.g. carpet versus pavement).

The foregoing and other advantages of the invention will appear from the following description. In this description reference is made to the accompanying drawings which form a part hereof and in which there is shown by way of illustration a preferred embodiment of the invention. This embodiment does not represent the full scope of the invention. Thus, the claims should be looked to in order to judge the scope of the invention.

BRIEF DESCRIPTION OF THE DRAWINGS

FIG. 6 is a schematic view of the top of FIG. 1, shown with a detachable tip separated from the top; and FIG. 7 shows an alternate embodiment of a detachable tip.

DETAILED DESCRIPTION OF THE PREFERRED EMBODIMENTS

Figure 1:
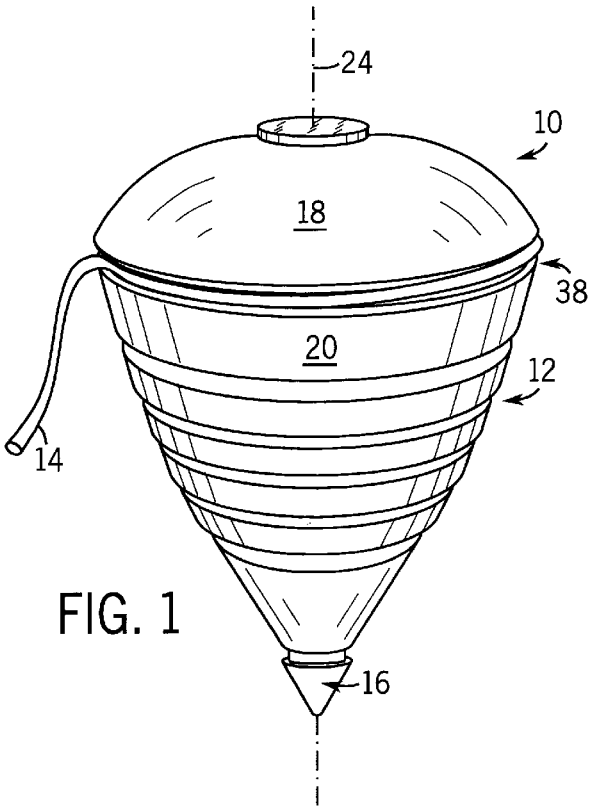
FIG. 1 is a perspective view of a preferred embodiment of the present invention, with the string wound in the top groove.
Figure 4:
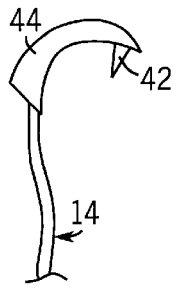
FIG. 4 is a partial side view of the catch portion of the pull-string of the present invention.
Figure 5:
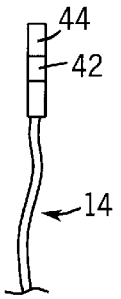
FIG. 5 is an end view of the pull-string of FIG. 4.
Figure 3:
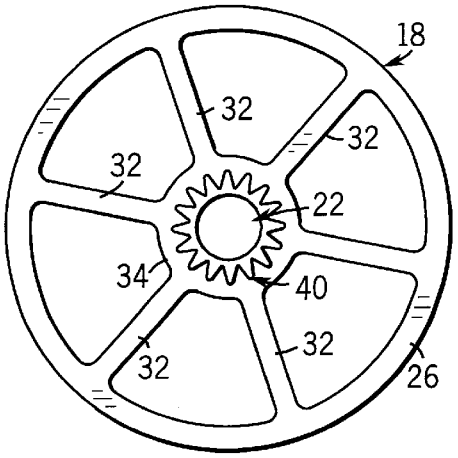
FIG. 3 is a bottom plan view of the upper portion of the top of FIG. 1.
Figure 2:
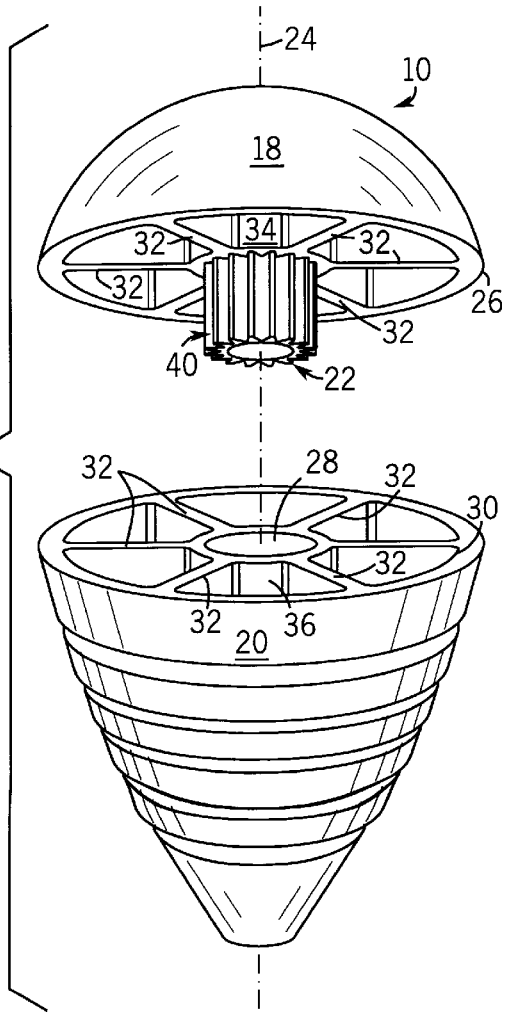
FIG. 2 is an exploded perspective view of two parts of the top of FIG. 1.

A preferred spinning top of the present invention is referred generally in the drawings by reference 10. Referring to FIGS. 1–3, the top is comprised primarily of a two-part body 12, a pull-string 14, and a detachable tip 16. The body 12 preferably includes an upper portion 18 and a lower portion 20 joined together by a hub 22, preferably of generally cylindrical configuration (e.g. in a splined form). The upper 18 and lower 20 portions, as well as the hub 22, can be made of a molded plastic, and the pull-string 14 is preferably a nylon cord. However, other suitable materials (e.g. wood for the body; natural rope for the cord) are also suitable.

When assembled, the body 12 and tip 16 are concentric with a vertical spin axis 24, as is the hub 22. The hub 22 is preferably unitary with the upper portion 18 extending downward from its bottom surface 26 so that, when the top 10 is assembled, the hub 22 is partially received in a recess 28 in an upper surface 30 of the bottom half 20.

The recess 28 is suitably sized so that the hub 22 and recess 28 form an interference fit. As best seen in FIGS. 2 and 3, the upper 18 and lower 20 portions can be of a hollowed construction having inner partitions 32 extending radially inward to respective central cylindrical members 34, 36 concentric with the spin axis 24.

The hub 22 is sized so that when seated within the recess 28 of the lower portion 20, the upper 18 and lower 20 portions are left separated to define a deep, washer-shaped radial groove 38 (see FIG. 6) in which the pull-string 14 can be wound. The size of the groove 38 can be such as to permit the pull-string 14 only to be wound in a single width spiral with each winding overlaying the last preceding winding. In this way, the pull-string 14 will not tend to become improperly intertwined such that it could bind during use. Alternatively, the gap could be even wider (e.g. like a yo-yo gap), with multiple windings at the same radial distance.

In accordance with the present invention, the hub 22 is formed with a series of vertical recesses or grooves 40. The pull string 14 is formed with a catch 44 that has an arc head end with an inwardly projecting tooth 42. The tooth is angled in a way such that it can smoothly catch in a groove 40 when a user grips catch neck 46 and positions the tooth into the groove. This is facilitated by angling the tooth towards the center of the hub.

The catch 44 of the pull-string 14 is preferably a suitable rigid plastic. However, it may be metal or other material.

The grooves 40 of the hub 22 and the tooth 42 are positively engaged in a rack and pinion type connection when the pull-string 14 is wound in a clockwise or a counterclockwise direction around the hub 22. The arcuate shape and narrow width of the catch 44 allow it to be easily inserted within the radial groove 38 in the proper orientation so that a recess and a tooth mate simply by tugging on the pull-string 14.

The pull-string 14 can then be wound quickly and easily within the groove 38. When the top 10 is thrown and the pull-string 14 is pulled, the pull-string 14 unwinds and the engaging members separate so that the pull-string 14 cleanly and smoothly released from the top 10.

Referring next to FIG. 6, the tip 16 can be detached from the body 12 of the top 10. Specifically, the cylindrical member 36 of the lower half 20 defines an axial bore 50 opening at the bottom of the lower part 52 which is sized to receive a generally cylindrical lug 52 of a detachable tip 16A. Preferably, the tip 16A is connected to the body 12 in a bayonet or slot and pin type connection. The bore 50 includes two opposing transversely projecting pins 54 extending from its inner diameter. The lug preferably has cylindrical walls 56 defining two opposing generally L-shaped slots 58 each having a transverse segment 60 joined at one end to a first axial leg 62 extending longitudinally to the top of the lug 52 and at an opposing end to a second axial leg 64 extending longitudinally toward the top of the lug, but less than that of the first axial leg 62.

A compression spring 66 is disposed within the bore 50 which is compressed when the tip lug 52 is inserted into the bore 50. The tip 16A is connected to the body by inserting the lug 52 into the bore 50 so that the pins 54 travel within the slots 58 to the second axial legs 64. The spring 60 keeps the slot and pin connection biased together. It should be noted that the same type of connection can be made with the pins 54 projecting outward from the circumference of a solid lug and the slots being in the inner diameter of the bore.

Referring to FIG. 7, alternatively, the bore of the lower half 20 and the lug 70 of a tip 16B may be threaded so that the tip 16B can be joined to the body 12 by threaded engagement. The tip 16B may also include nut-like surfaces 72 for loosening and tightening the tip with a wrench.

The detachment of a tip allows it to be replaced, thus, increasing the useful life of the rest of the top. Moreover, this allows the top to be used with tips of various colors or profiles for changing the appearance of the top, or when using the top on different surfaces. For example, flatter radius tips may be preferred on carpeted surfaces.

The above describes preferred embodiments of the top of the present invention. However, the body may instead be one piece with the tip being an integral part of the body. Alternatively, detachable tips may be connected to the body via other types of connections. Also, a replaceable ring with grooves may be fit over a standard hub to create a hub with grooves. The grooves need not be integral with the hub which is part of the body.

INDUSTRIAL APPLICABILITY

The above disclosure provides toy tops which are well suited for use by young children.

What is claimed is:

1. A spinning top, comprising:

a body having a vertical spin axis, a bottom tip, and a radial groove extending perpendicular to the spin axis and extending into the body to define a cylindrical hub essentially concentric with the spin axis;

a recess formed on the hub which is accessible from the radial groove; and a flexible line windable in the groove about the hub, the line having a catch at one end that is matable with the recess;

whereby the catch and recess can be mated such that the line can be used to apply a transverse force to the body so as to rotate the top about the spin axis on its tip, with the catch and recess capable of separating from each other when the line is completely unwound from the hub.

2. The top of claim 1, wherein the recess is a vertical groove and the catch has a tooth.

3. The top of claim 2, wherein the catch has an arc head adjacent the tooth.

4. The top of claim 1, wherein the body is comprised of an upper part including a transverse lower surface and a lower part including a transverse upper surface, the upper and lower parts being joined together such that the lower and upper surfaces define the groove.

5. The top of claim 4, wherein the hub is integrally formed with the upper part.

6. The top of claim 5, wherein the lower part has a recess sized to receive a portion of the hub in a press fit.

7. The top of claim 1, wherein the tip is removable from the body, and wherein the body includes an axial bore concentric with the spin axis adjacent its lower end, and the tip includes a longitudinal lug sized to fit within the bore.

8. The top of claim 7, wherein the bore and the lug include matable threads for securing the tip to the body.

9. The top of claim 7, further comprising a spring within the bore and wherein the tip is secured to the body via a slot and pin connection that is biased together by the spring.

* * * * *